US008140249B2

(12) United States Patent
Hessling et al.

(10) Patent No.: US 8,140,249 B2
(45) Date of Patent: Mar. 20, 2012

(54) METHOD FOR ENCODING MESSAGES, METHOD FOR DECODING MESSAGES, AND RECEIVER FOR RECEIVING AND EVALUATING MESSAGES

(75) Inventors: Matthias Hessling, Hildesheim (DE); Michael Laedke, Hildesheim (DE); Jens Zombetzki, Isernhagen (DE)

(73) Assignee: Robert Bosch GmbH, Stuttgart (DE)

( * ) Notice: Subject to any disclaimer, the term of this patent is extended or adjusted under 35 U.S.C. 154(b) by 614 days.

(21) Appl. No.: 12/158,927

(22) PCT Filed: Nov. 22, 2006

(86) PCT No.: PCT/EP2006/068746

§ 371 (c)(1),
(2), (4) Date: Nov. 18, 2008

(87) PCT Pub. No.: WO2007/073996

PCT Pub. Date: Jul. 5, 2007

(65) Prior Publication Data

US 2009/0265087 A1 Oct. 22, 2009

(30) Foreign Application Priority Data

Dec. 22, 2005 (DE) ..... 10 2005 062 019

(51) Int. Cl.
*H04H 20/55* (2008.01)
*G08G 1/09* (2006.01)
*G06G 7/76* (2006.01)

(52) U.S. Cl. ..... 701/117; 340/995.13; 709/236

(58) Field of Classification Search ..... 701/1, 117–119, 701/200, 207, 208; 340/901, 905, 988, 995.1, 340/995.12, 995.13; 709/201–203, 230, 709/231, 236

See application file for complete search history.

(56) References Cited

U.S. PATENT DOCUMENTS

| | | | | |
|---|---|---|---|---|
| 5,164,904 | A * | 11/1992 | Sumner | 701/117 |
| 5,173,691 | A * | 12/1992 | Sumner | 340/905 |
| 5,182,555 | A * | 1/1993 | Sumner | 340/905 |
| 6,477,459 | B1 * | 11/2002 | Wunderlich | 701/209 |
| 6,597,982 | B1 | 7/2003 | Schmidt | |
| 6,741,932 | B1 * | 5/2004 | Groth et al. | 701/210 |
| 6,865,480 | B2 * | 3/2005 | Wong | 701/210 |
| 6,924,751 | B2 * | 8/2005 | Hempel et al. | 340/995.12 |
| 6,931,320 | B2 * | 8/2005 | Mori et al. | 701/212 |
| 6,990,407 | B1 * | 1/2006 | Mbekeani et al. | 701/117 |

(Continued)

FOREIGN PATENT DOCUMENTS

DE 35 36 820 4/1987

(Continued)

OTHER PUBLICATIONS

Davies, The Radio System—Traffic Channel, Sep. 1989, Record of the Vehicle Navigation and Information Systems Conference '89, pp. A44-A48.*

(Continued)

*Primary Examiner* — Thomas Black
*Assistant Examiner* — Lindsay M Browder
(74) *Attorney, Agent, or Firm* — Kenyon & Kenyon LLP

(57) ABSTRACT

Method for encoding messages which are to be transmitted, method for decoding messages, and receiver for receiving and evaluating messages, in particular traffic messages, wherein the messages include message contents, and wherein a message contains at least one reference to an additional supplementary message which is to be transmitted separately and contains supplementary message contents.

2 Claims, 5 Drawing Sheets

U.S. PATENT DOCUMENTS

| | | | | |
|---|---|---|---|---|
| 6,996,089 | B1 * | 2/2006 | Ruf et al. | 701/117 |
| 7,050,903 | B1 * | 5/2006 | Shutter et al. | 701/117 |
| 7,096,115 | B1 * | 8/2006 | Groth et al. | 701/117 |
| 7,139,659 | B2 * | 11/2006 | Mbekeani et al. | 701/117 |
| 7,145,479 | B2 * | 12/2006 | Fastenrath | 340/995.13 |
| 7,307,513 | B2 * | 12/2007 | Shutter et al. | 701/117 |
| 7,605,720 | B1 * | 10/2009 | Menzies et al. | 340/995.13 |
| 7,634,361 | B2 * | 12/2009 | Levesque et al. | 701/210 |
| 7,783,415 | B2 * | 8/2010 | Yamane et al. | 701/117 |
| 2001/0028314 | A1 | 10/2001 | Hessing et al. | |
| 2008/0088486 | A1 * | 4/2008 | Rozum et al. | 340/995.13 |

FOREIGN PATENT DOCUMENTS

| | | | |
|---|---|---|---|
| DE | 199 05 893 | | 8/2000 |
| DE | EP1118972 | * | 7/2001 |
| DE | 100 15 935 | | 10/2001 |
| DE | 10105468 | * | 12/2002 |
| DE | EP1339180 | * | 8/2003 |
| DE | EP1376512 | * | 1/2004 |
| EP | 1 445 750 | | 8/2004 |
| EP | 1 460 599 | | 9/2004 |
| JP | 7311894 | * | 11/1995 |
| JP | 2006127134 | * | 5/2006 |
| WO | WO9625815 | * | 8/1996 |
| WO | WO 01/06478 | | 1/2001 |

OTHER PUBLICATIONS

International Search Report, PCT/EP2006/068746, dated Feb. 9, 2007.

* cited by examiner

METHOD FOR ENCODING MESSAGES, METHOD FOR DECODING MESSAGES, AND RECEIVER FOR RECEIVING AND EVALUATING MESSAGES

FIELD OF THE INVENTION

The present invention relates to a method for encoding messages, a method for decoding messages, and a receiver for receiving and evaluating messages.

BACKGROUND INFORMATION

It is described in German Published Patent Application No. 35 36 820 and ISO 14819 that traffic messages in the form of digitally encoded messages plus radio programs may be broadcast over radio frequencies to describe traffic-relevant situations, in particular traffic disturbances in the highway system. These TMC (Traffic Message Channel) traffic messages include location information about the location of a traffic disturbance in an encoded form.

ISO 14819 also describes so-called multisequence messages in which traffic information is transmitted in several groups of the RDS signal, but the several groups which include traffic information must always be transmitted in direct succession.

German Published Patent Application No. 199 05 893 describes an expansion of traditional traffic messages according to the TMC standard. It is provided there that a supplementary location description, which is announced in a header preceding the actual message, is to be added to the standardized messages, which regularly contain a location code and thus a reference to a location of a traffic-relevant event. Thus, a location description is no longer limited merely to highway junctions, highway intersections and interchanges and the like and/or the sections in between that are encoded in the TMC location database but instead it allows a further description of the event location.

A more accurate localization of an event location is also the subject of German Published Patent Application No. 100 15 935. It is proposed there that in addition to a section of road affected by a traffic disturbance, which may be defined by an adjacent location encoded in the TMC location database, a portion of a section or comparable linear parameters may also be transmitted, permitting a more accurate localization of the event location on the encoded section of road.

The traffic situations to be transmitted via a traffic message may be simple or complex; for example, "10 km backed-up traffic" is a simple description of the situation and "10 km backed-up traffic, construction site, lane closure, average speed=20 km/h" is a complex description of the situation. Such complex situation descriptions may be described by so-called "multisequence messages," i.e., multiple indexed successive individual messages in TMC (Traffic Message Channel, as specified in ISO 14819).

One disadvantage here is that all the individual events of a complex situation description must always be based on the same location, i.e., the same section of road, so that the message may be displayed on the terminal as a complex situation description. Furthermore, all the events of a situation must be sent at the same point in time. Although updating is possible, all messages, including all the events they contain, must always be updated. It is impossible to append additional events to a message already sent. Expanded complex example: "Between Laatzen junction and Hildesheim junction 10 km backed-up traffic, construction site, lane closure, average speed=20 km/h." The individual events of "backed-up traffic," "construction site," "lane closure," and "average speed=20 km/h" must be based on the same location, namely in this case the same section of road between junctions. If the events overlap or if they are based on different neighboring locations, multiple separate messages must be transmitted. It is very complex to combine the messages at the terminal end to allow a compact presentation.

It is also a disadvantage that it is impossible to correlate messages originating from different sources. In the future it may be expected that situation descriptions of differing content will be supplied by different sources. For example, traffic disturbances such as congestion or accidents are compiled by the police via the state reporting offices, while long-term status information such as construction sites or gridlock is supplied by third-party providers—possibly even as a paid service. Example: real situation: "10 km congestion and 5 km construction site." It is assumed that the construction site will remain in existence for a longer period of time and the message will be transmitted regularly by provider X, e.g., a radio station. Congestion occurs spontaneously and is reported by a state reporting office for a relatively short period of time. With the digitally encoded TMC traffic messages currently being transmitted by radio, there is no possibility of connecting two individual messages to form one complex message.

SUMMARY

Drivers would like to have a compact display of the traffic situation, so they are able to more easily recognize the overall state of affairs and better estimate the on-site situation. For example, congestion would be combined with a subsequent construction site, so the driver would first be notified only of the event that is the most important for him instead of being notified of two independent individual events.

Example embodiments of the present invention having the features described herein make it possible to characterize complex traffic situations whose individual events overlap or interlace at the same location or traffic situations that are in direct proximity to one another or traffic situations sent out by different providers or traffic situations that occur in separate locations and have a different relationship to one another, e.g., due to direct effects of a traffic disturbance on a subsequent disturbance, in such a way that they are recognized by the receiving terminal as belonging together and may be displayed in a compact manner.

In this procedure, the terminal is able to determine exactly which particular messages must be received before a complete description of the traffic situation may be released to further processing components, e.g., display, voice, and/or route calculation of a driver information system. This makes it possible to avoid unnecessary route calculations or changing map and/or text displays of the messages.

In addition, example embodiments of the present invention allow prioritization of individual events in processing, display, or announcement by the terminal. The present invention also allows a compact text display and map display of interlaced events by the terminal. Information to the user, in particular the driver of a vehicle, may be structured such that the most important event, in particular the one of multiple events having the most serious effect, e.g., on the traffic flow on a section of road, is displayed first and details are displayed only on further request. This avoids flooding of stimuli or information to the user.

In the method according to example embodiments of the present invention for encoding messages to be transmitted, in particular traffic messages, where the messages include message contents, it is also provided that a message has at least one reference to an additional supplementary message to be transmitted separately, the additional supplementary message containing supplementary message contents. Separate here means that the message and the supplementary message(s) need not necessarily be sent directly in succession in the data stream and any interval in time may separate one from the other (within limits).

Exemplary embodiments of the present invention are depicted in the figures and explained in greater detail below.

DETAILED DESCRIPTION

The method according to example embodiments of the present invention for encoding messages is described by way of the example of traffic messages, i.e., messages about traffic disturbances or other traffic-relevant messages, e.g., via radio such as VHF radio or digital radio by a radio transmitter to a plurality of radio receivers.

Figure 1:
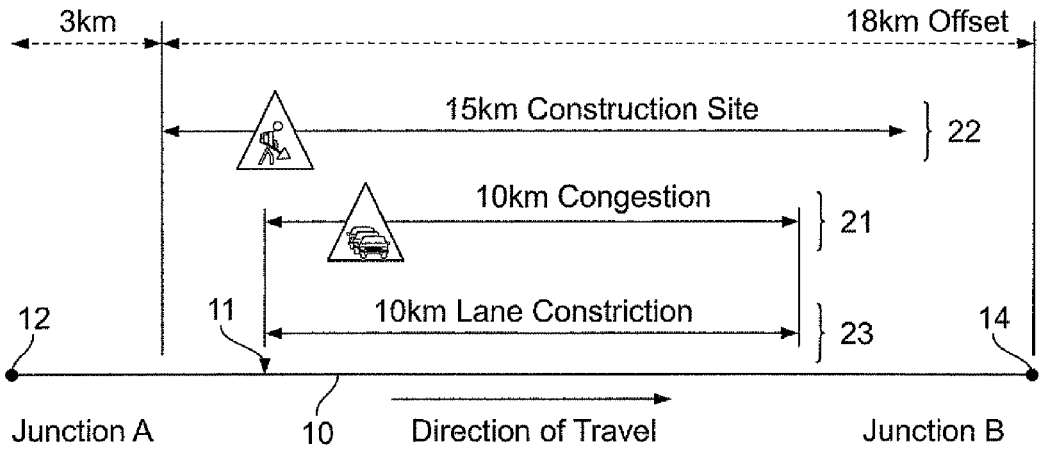
FIG. 1 shows a schematic diagram of interlaced traffic events.

FIG. 1 shows a section of road 10, e.g., a highway section 10 in the present case, between a first junction A (reference numeral 12) in the direction of travel and a second junction B (reference numeral 14). This section of road has a total length of 21 km. Several events of relevance to traffic taking place on this section of road are interrelated. On a section of road 10, 3 km from first junction A (12), there is a construction site 15 km long (reference numeral 22). Furthermore, within the construction site there is a lane closure (from three lanes to two lanes) for a distance of 10 km (reference numeral 23). Due to the construction and/or lane closure, there is congestion for 10 km in this area (reference numeral 21).

Figure 2:
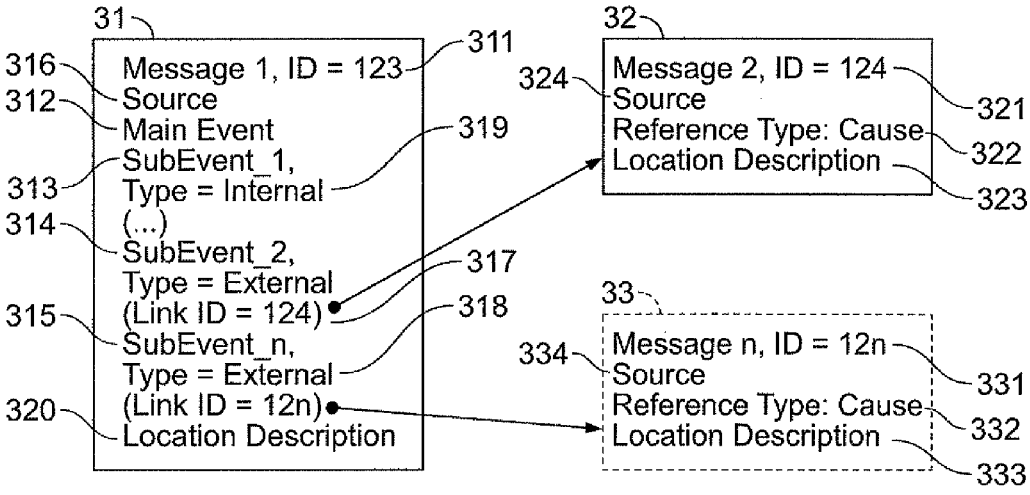
FIG. 2 shows the basic design of messages, in particular traffic messages, encoded according to example embodiments of the present invention.

To describe such interlinked traffic events, they are encoded in a message format according to example embodiments of the present invention, as shown in FIG. 2.

A message according to example embodiments of the present invention, here a traffic message, initially includes a main message 31 (message 1), which has a message identification (ID) 311, here 123. This main message 31 includes the most important event (main event) 312 for the driver and/or his route, e.g., congestion, as the message content. In addition, the message may, if necessary, also include other so-called implicit events (subevent_1, reference numeral 313, subevent_2, reference numeral 314, . . . subevent_n, reference numeral 315), e.g., construction site, lane closure, etc., if they have the same local reference as main event 312. If the local reference of additional implicit events 313, 314, 315 is not the same or if there is detailed information from a provider other than the provider of the main message, then the main message may contain so-called "external" subevents 314, 315, reference being made to a special message 32, 33 containing additional information for each of these external subevents 314, 315. The reference to particular additional messages containing external subevents 314, 315 is made, for example, by giving their message IDs (link ID=124, reference numeral 317, link ID=125,reference 318).

In addition, an element "source" (reference numeral 316) may also be provided, characterizing the provider of the message. Furthermore, a type designation (reference numeral 319) may also be provided, preferably for each event and/or subevent, indicating whether it is an event transmitted in main message 31 (type=internal) or whether it is an external event, i.e., an event transmitted in an additional supplementary message 32 or 33 (type=external).

Finally, the message preferably also has a location description 320, in particular in the case of a traffic message, indicating to which location the transmitted traffic message refers.

Additional messages, i.e., supplementary messages 32 and 33 to which reference is made by link IDs 317 and 318, also include a message identifier (ID=124, reference numeral 321; ID=12n, reference numeral 331).

Additional messages 32 through 33 may optionally contain information about the cause (refer-type=cause, reference numerals 322 and 332) and may complete the complex state of affairs of the traffic situation. In addition, the additional messages may also include additional location descriptions 323 and 333 as well as a statement about the message supplier (source) 324 and 334. The location descriptions of the supplementary messages may describe the locations of the events contained in the supplementary messages and may thus replace and/or supplement the location descriptions of the main message.

The message structure described here has the particular advantage that main message 31 already includes in approximate form the entire complexity of the state of affairs to be described. The receiving terminal thus knows how many messages must still be received to completely represent the state of affairs.

Figure 3A:
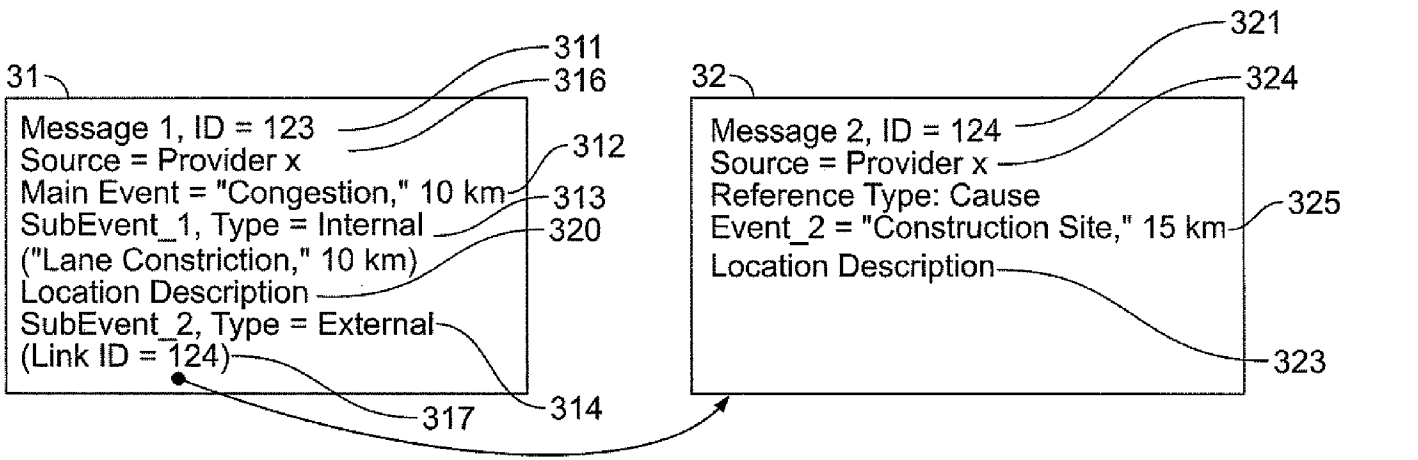
FIGS. 3A and 3B show the structure of a traffic message to describe the traffic events according to FIG. 1.
Figure 3B:
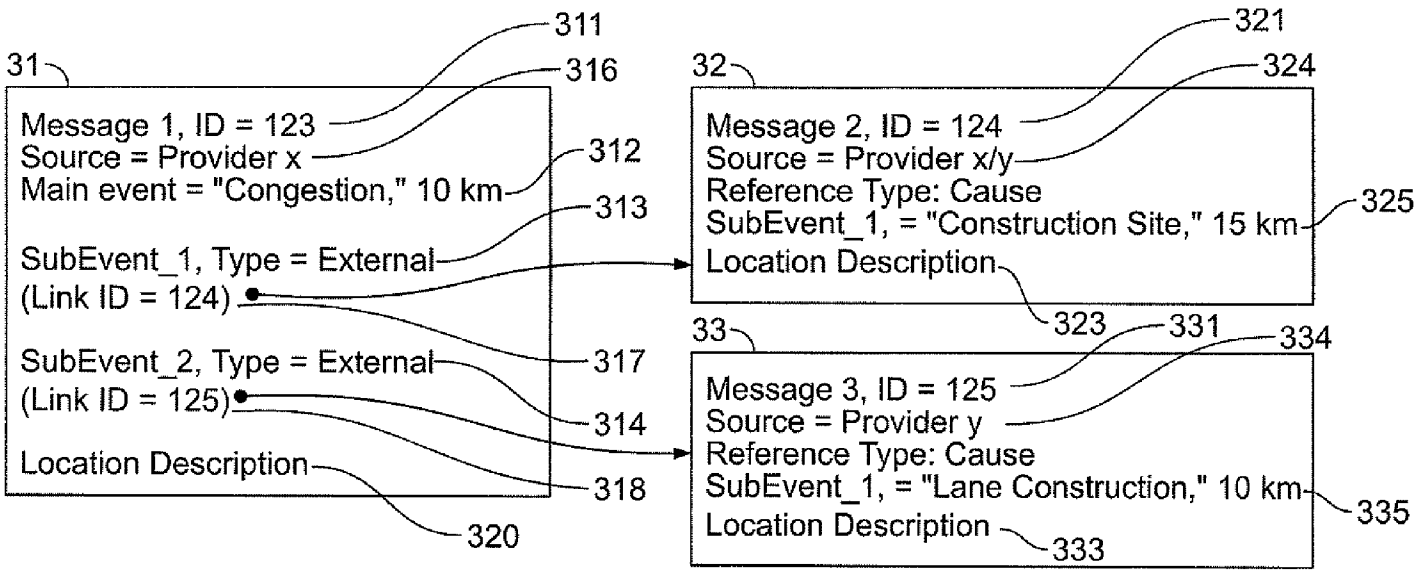

FIGS. 3A and 3B show the concrete structure of the traffic messages according to example embodiments of the present invention to describe the traffic situation according to FIG. 1.

It is assumed here that of the traffic-relevant events indicated, namely 15 km construction site (reference numeral 22), 10 km lane closure (reference numeral 23) and 10 km congestion (reference numeral 21), congestion 21 is the event having the most serious effect for a driver of a vehicle and/or a route calculation in a vehicle navigation system.

Since congestion 21 and lane closure 23 have the same local reference, namely the beginning of the congestion and the beginning of the lane closure within construction site 22 coincide at same location 11, these two events are transmitted with message number (ID=123) 311 as main event 312 and secondary event (subevent_1) 313 in main message 31 (FIG. 3A).

The main message includes a characterization, i.e., description of the main event, namely here congestion for a distance of 10 km (reference numeral 312), the reference to the information provider, here provider X (reference numeral 314), and the location of the event (reference numeral 320), here, for example, the distance from the start of the congestion to junction A and/or to the two junctions themselves. In addition, main message 31 includes information about the internal subevent, namely lane closure 23, specifically its description 313 and the information that it is an "internal" subevent (entry "type=internal").

On the other hand, information about the additional subevent, namely construction site 22, is transmitted as an additional subevent (subevent_2) in additional message 32 because it has a different location reference, namely not the start of the lane closure but instead a point in front of that in the direction of travel on road section 10. In main message 31, a reference is made to additional message 32 in which information about the additional subevent, namely construction site 22, is transmitted, with a statement about the existence of this additional subevent_2 (reference numeral 314) by giving the message number (link ID=124, reference numeral 317). Furthermore, a reference is assigned to entry 314, indicating that the additional subevent is a so-called "external" subevent for which information is transmitted in a supplementary message.

The supplementary message includes the additional information about the subevent, i.e., construction site 22. This includes a description of the subevent, i.e., traffic disturbance "construction site, 15 km" (325), the location of the event, i.e., here 3 km after junction A (323), indicating the information provider (324) plus message ID 124 (321).

The encoding according to FIG. 3B differs essentially from that in FIG. 3A due to the fact that here the information about subevent 1, i.e., lane closure 23, is made available by a different provider than the information about the main event, i.e., congestion 21.

Consequently, the information about the lane closure here (in comparison with FIG. 3A) is not transmitted within main message 31 but instead is transmitted in additional supplementary message 33, to which reference is made in the main message (314, 318).

Additional supplementary message 33, like first supplementary message 32, then includes the additional information about the additional subevent, i.e., lane closure 23. This is a description of the subevent, i.e., the traffic disturbance "lane closure 10 km" (335), the location of the event, i.e., here the start of the lane closure (333), indicating the information provider, namely "Y" (334) here plus message ID 125 (331).

Figure 6:
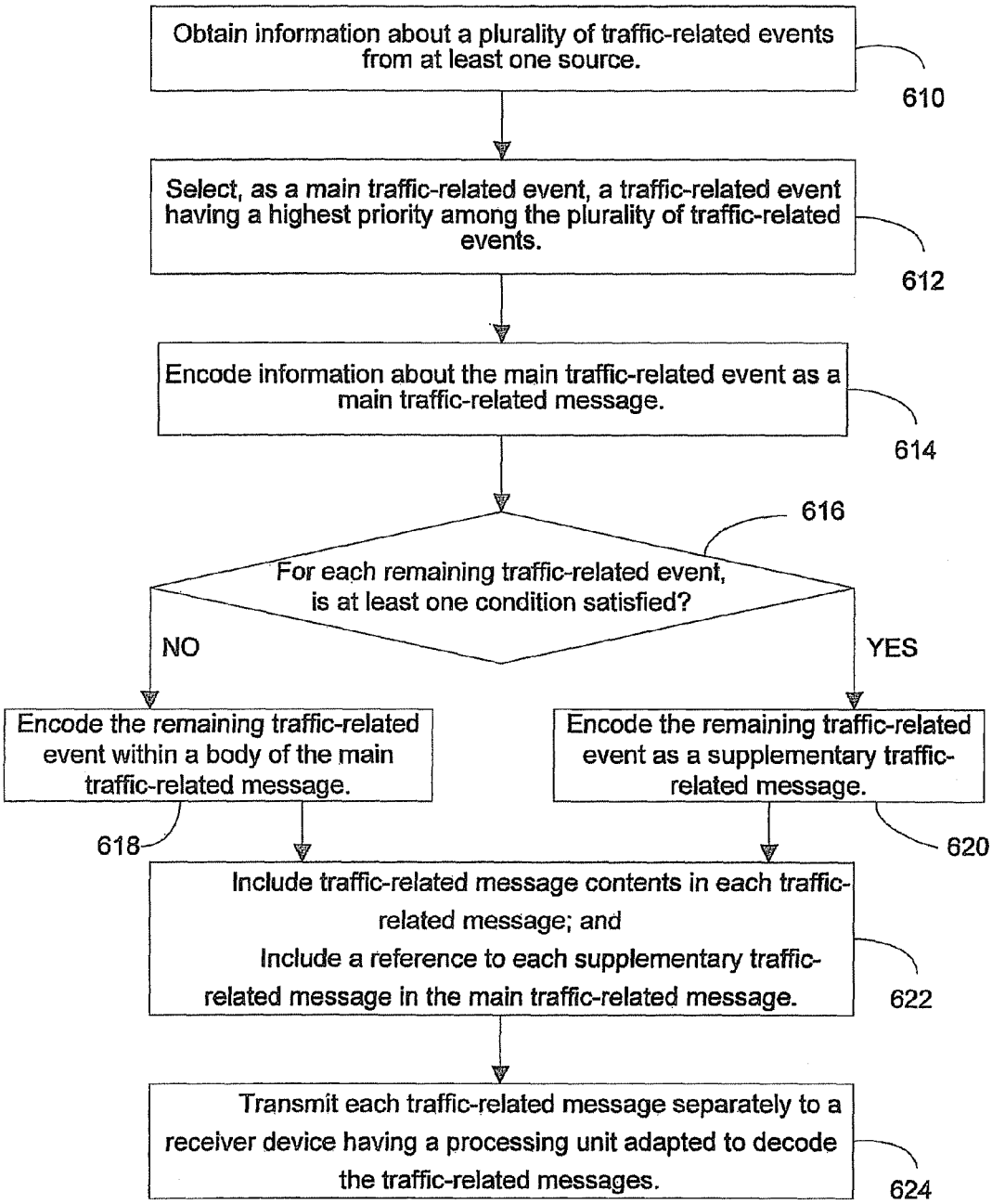
FIG. 6 shows a flow chart of a method for encoding messages to be transmitted according to an example embodiment of the present invention.

FIG. 6 shows a flow chart of a method for encoding messages to be transmitted in accordance with the example embodiments previously described.

In step 610, information about a plurality of traffic-related events are obtained from at least one data source. As previously discussed, messages may be supplied by different sources, including police and third-party providers.

In step 612, a traffic-related event that has a highest priority among the plurality of traffic-related events is selected as a main traffic-related event. For example, as previously described, the main message can be the most important message for the driver and/or his route, e.g., congestion.

In step 614, information about the main traffic-related event is encoded as a main traffic-related event, e.g., main message 31 in FIGS. 2, 3A and 3B.

Figure 7:
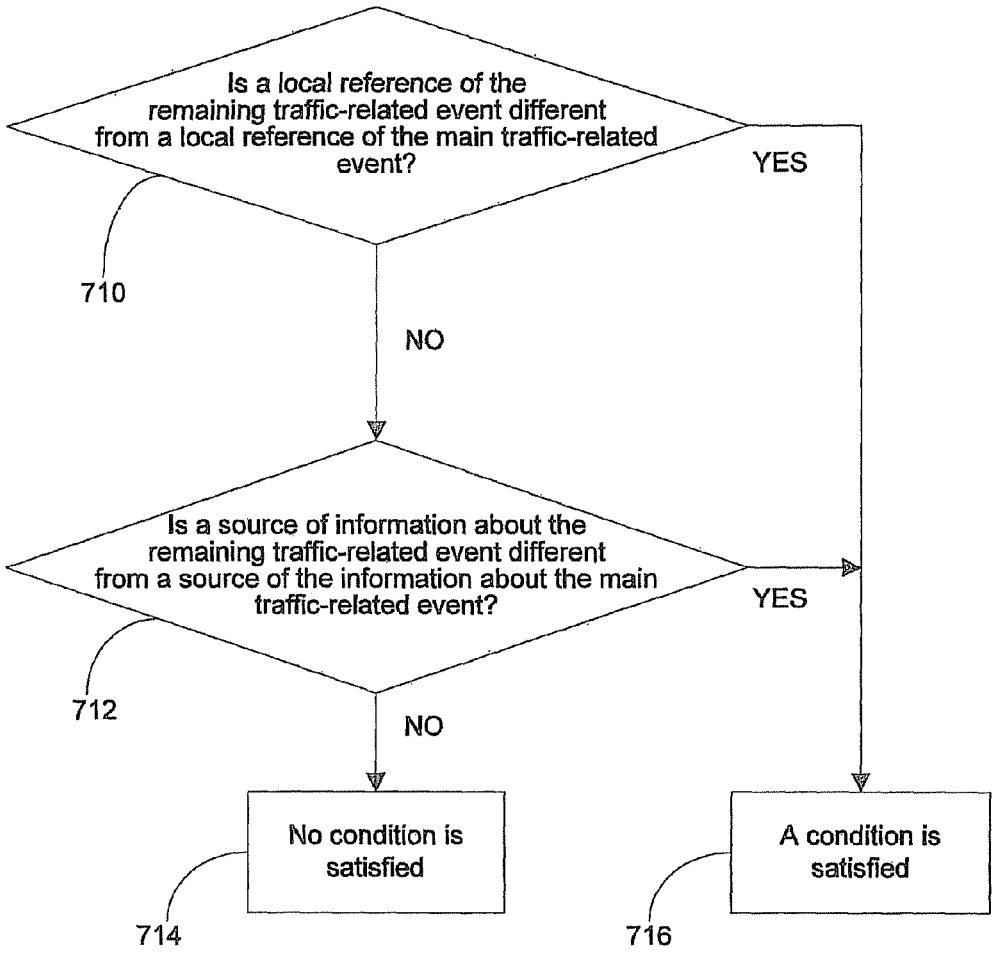
FIG. 7 shows a flow chart of a method for determining whether at least one condition is satisfied for a particular traffic-related event.

In step 616, it is determined for each remaining traffic-related event whether at least one of the following conditions is satisfied: (i) a local reference of the remaining traffic-related event is different from a local reference of the main traffic-related event (FIG. 7, 710) and (ii) a source of information about the remaining traffic-related event is different from a source of information about the main traffic-related event (FIG. 7, 712).

If neither of the conditions is satisfied (FIG. 7, 714), then the remaining traffic-related event is encoded within a body of the main traffic-related message (step 618), e.g., encoded as the subevent 313 in FIG. 2.

However, if at least one condition is satisfied (FIG. 7, 716), then the remaining traffic-related event is encoded as a supplementary traffic-related message (step 620), e.g., encoded as one of the external subevents 314 and 315 in FIG. 2. Thus, as previously described, the remaining traffic-related events are categorized as non-external or external subevents, and encoded accordingly.

In step 622, traffic-related message contents are included in each traffic-related message. For example, as previously described, the main message may include information about the main event as its message content. Additionally, a reference to each supplementary traffic-related message is included in the main message. For example, as previously described, the main message may include a message number of an external subevent along with an indication that the subevent is external.

Figure 4:
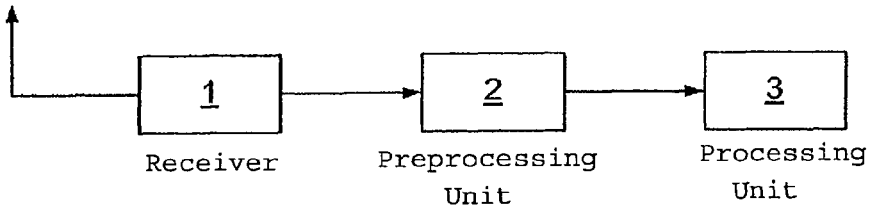
FIG. 4 shows a block diagram of a terminal for processing messages linked according to example embodiments of the present invention.

In step 624, each traffic-related message is transmitted separately to a receiver device having a processing unit adapted to decode the traffic-related messages, e.g., the receiver shown in FIG. 4. As previously mentioned, "separate" here means that the main message and the supplementary message(s) need not necessarily be sent directly in succession in the data stream and any interval in time may separate one from the other.

FIG. 4 shows as an example a device for processing encoded messages received according to example embodiments of the present invention on the basis of the block diagram of a radio receiver, e.g., for DAB, DVB, DRM, VHF-FM radio, or satellite radio. The present invention is not limited to radio receivers, but instead may also be implemented using other types of wireless receivers, e.g., receivers for beacon communication, e.g., in the case of Maut, the Japanese VICS (Vehicle Information and Communication System), etc.

The actual radio receiver, i.e., the receiver part, is labeled as 1; a preprocessing unit for traffic messages belonging together is labeled as 2 and is connected to receiving part 1, where the corresponding method for assembling individual submessages 31, 32 and, if necessary, additional messages to form a resulting overall message and relay it to block 3 is implemented. Block 3 contains a unit that further processes the content of the assembled messages, i.e., the resulting messages, e.g., a display or a navigation system having a route calculation component.

An aspect according to example embodiments of the present invention relates to the characterization and preprocessing of assembled messages of complex traffic situations and complex display thereof in the terminal. After the messages have been combined in the terminal, the display may be in a compact graphic or text form.

The display of the communication generated from the messages that have been encoded, received, and evaluated according to example embodiments of the present invention in the terminal might then appear as follows:

1) In a first view, for example, a communication having the following content would be displayed:

"Congestion for 10 km between junction A and junction B"

2) In a second detailed view retrievable by the user through an appropriate operator entry, the supplementary message "because of 15 km construction site and 10 km lane closure" could be displayed, indicating the cause of the traffic event.

For the display on the terminal, the received messages encoded according to example embodiments of the present invention must first be decoded and combined to yield the resulting message.

Figure 5:
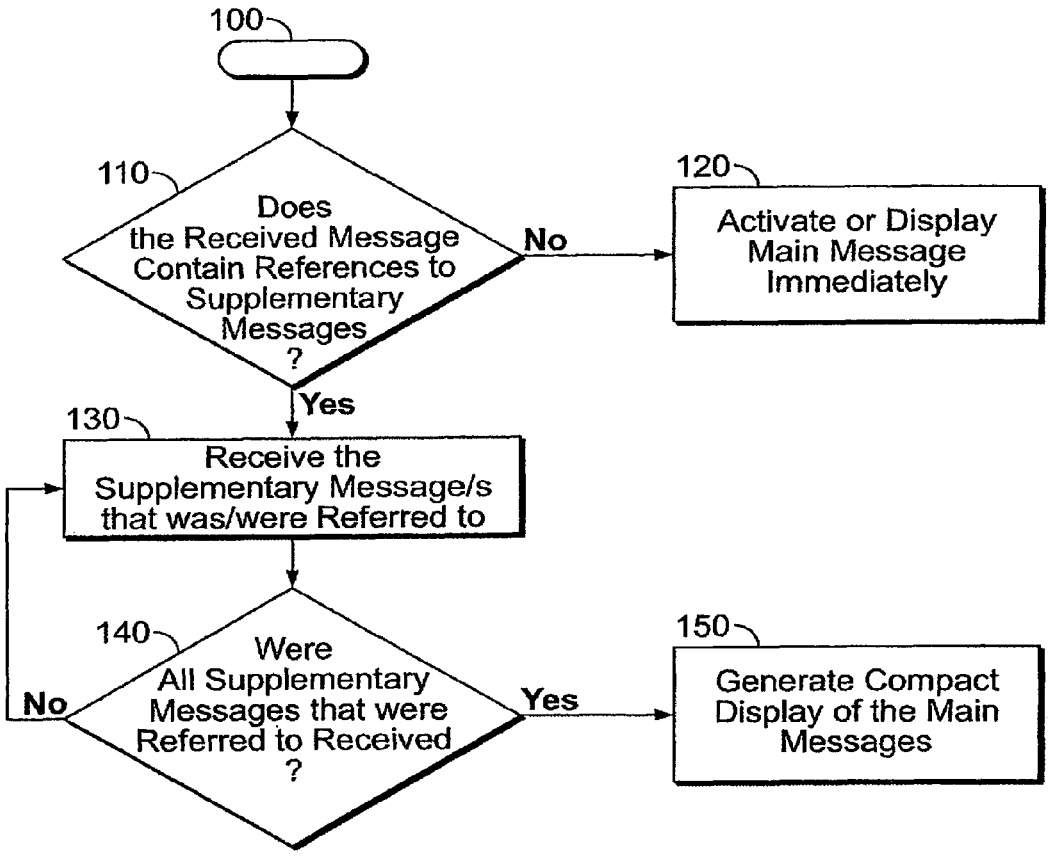
FIG. 5 shows a flow chart for processing of messages encoded according to example embodiments of the present invention in a terminal according to FIG. 4.

The required sequence is illustrated on the basis of a flow chart in FIG. 5.

The sequence begins in step 100 with tuning receiving part 1 to a radio transmitter, which transmits messages encoded according to example embodiments of the present invention, in particular traffic messages. In the present example, this is a VHF radio transmitter, for example, that transmits not only the radio program but also digitally encoded information via the radio data signal (RDS) according to DIN EN 50 067.

Step 110 checks on whether received messages 31 contain references 317, 318 to supplementary messages 32, 33. If this is not the case, i.e., if no supplementary messages are transmitted for a received message, the content of received message 30 may be decoded immediately and sent for further processing 120 (block 3), i.e., displayed on a display screen or included in a route calculation for a navigation system 3.

If received message 31 contains one or more references 317, 318 to supplementary messages 32, 33, then these are entered in step 130. Step 140 checks on whether all supplementary messages referenced have been entered. This check may be performed, e.g., by comparing referenced messages IDs 321, 331 of supplementary messages with references 317, 318 of the main message. If not all referenced supplementary messages have been entered, the sequence continues with further input of supplementary messages in step 130.

If all referenced supplementary messages 32, 33 for main message 31 have been entered, then in step 150 a resulting message in a compact display is generated from the message contents of the main messages and the supplementary messages. In the case of the example of FIGS. 1 and 3B, the main event, for example, is combined with the particular location description as the main message "Congestion for 10 km between junction A and junction B"

The subevents are combined as an explanation of the supplementary message

"because of 15 km construction site ('3 km after junction A') and 10 km lane closure ('5 km after junction A')"

or

"because of 15 km construction site ('3 km after junction A') and 10 km lane closure ('2 km after start of construction site')"

which may be retrieved on special request by the user through a corresponding operator input, for example. The additions in parentheses may be reserved for output in a third concretization level or may already be output with the first detailing.

An advantage of example embodiments of the present invention is also the fact that the location information for certain main events or subevents, for example, may be linked to resulting location information on the basis of the location information in the main message and supplementary messages.

EXAMPLE

It is assumed that the location information transmitted in main message 31 as the location information for the congestion is 5 km after junction A.

It is also assumed that the location information transmitted for the construction site in first supplementary message 32 is 3 km after junction A.

Finally, it is assumed that the location information for the lane closure transmitted in second supplementary message 33 is 5 km after junction A.

From these message contents, the receiver is able to assemble a resulting message in the approximate form "Congestion for 10 km between junction A and junction B"

with the supplement

"because of 15 km construction site, start of construction 3 km after junction A"

And

"Start of congestion 2 km after start of construction site."

In other words, from the individual information of the individual messages, resulting information, e.g., 2 km after the start of the construction site here, may be calculated or otherwise synthesized, facilitating an orientation for the user. This text information may be displayed on a display screen or output by voice output, in particular using a voice synthesizer system.

According to a further example embodiment of the present invention, further input of referenced supplementary messages may be terminated if a predetermined period of time for input of supplementary messages is exceeded. This ensures that messages will in any case be output promptly after receipt of the corresponding messages.

What is claimed is:

1. A method, comprising:

obtaining information about a plurality of traffic-related events from at least one source;

selecting, as a main traffic-related event, a traffic-related event having a highest priority among the plurality of traffic-related events;

encoding information about the main traffic-related event as a main traffic-related message;

for each remaining traffic-related event in the plurality of traffic-related events, encoding the remaining traffic-related event as a supplementary traffic-related message when one of the following conditions exists:

a local reference of the remaining traffic-related event is different from a local reference of the main traffic-related event; or a source of information about the remaining traffic-related event is different from a source of the information about the main traffic-related event; and transmitting each traffic-related message separately to a receiver device having a processing unit adapted to decode the traffic-related messages;

wherein each traffic-related message includes traffic-related message contents, and the main traffic-related message includes a reference to each supplementary traffic-related message.

2. The method according to claim 1, further comprising:

when none of the conditions exists for a particular remaining traffic-related event, encoding the remaining traffic-related event within a body of the main traffic-related message.

* * * * *